United States Patent [19]

DiNardo

[11] 4,349,120

[45] Sep. 14, 1982

[54] PLASTIC BOX HINGE

[75] Inventor: Richard DiNardo, Leominster, Mass.

[73] Assignee: Bay State Plastics Corp., Leominster, Mass.

[21] Appl. No.: 272,301

[22] Filed: Jun. 10, 1981

[51] Int. Cl.[3] ..... B65D 43/14; B65D 51/04

[52] U.S. Cl. ..... 220/337; 220/335; 220/338

[58] Field of Search ..... 220/335, 337, 338; 16/128

[56] References Cited

U.S. PATENT DOCUMENTS

| | | | |
|---|---|---|---|
| 2,797,840 | 7/1957 | Gibbs | 220/338 |
| 3,023,923 | 3/1962 | Geib et al. | 220/338 |
| 3,295,713 | 1/1967 | Optner | 220/337 |

*Primary Examiner*—George T. Hall

*Attorney, Agent, or Firm*—Charles R. Fay

[57] ABSTRACT

An all plastic box and cover therefor including snap-in hinge-forming parts having associated therewith tabs that prevent misassembly and also acting as stops preventing the cover from opening past a 180° relation with the box.

3 Claims, 7 Drawing Figures

PLASTIC BOX HINGE

BACKGROUND OF THE INVENTION

There are many different types of hinges for plastic box covers, but in cases where assembly is needed, it sometimes takes a difficult procedure to align the male and female parts for snapping the cover hinge portion to the box hinge portion; and in other cases when the box is open, it may open too far or sag to a position more than 180° with respect to the box. In some cases this is not desirable as for instance in a first aid plastic kit; and it is the object of the present invention to provide a snap-in type plastic hinge construction wherein the box can only be assembled in one way and in which at the same time the elements that go to prevent misassembly of the parts also provide against opening of the box past 180°.

SUMMARY OF THE INVENTION

In the present case, the box and cover have two separate and spaced snap-in parts to assemble the cover in a swinging relation with respect to the box wherein the box is completely closed in one position and completely open in the other. Both box and cover are provided with extra extensions or tabs which interfere with any mode of assembly except the correct one and which also provide stops impinging upon each other providing against opening of the cover past 180°.

The snap-in hinge is provided by a female hook-type member which receives a short straight cylindrical pin-like member on the cover, this member being spaced from the edge of the cover and aligning with the hook-like member for the snap in assembly. The plastic material of box and cover provide securement preventing accidental disassembly.

PREFERRED EMBODIMENT OF THE INVENTION

Figure 1:
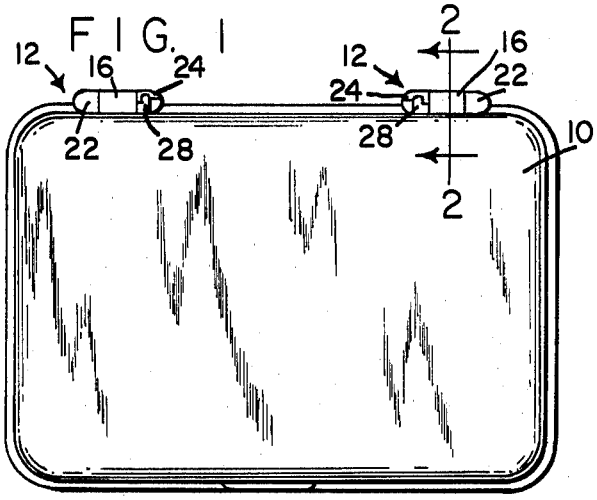
FIG. 1 is a top plan view showing the new hinge.
Figure 7:
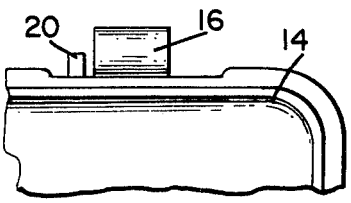
FIG. 7 is a plan view of a corresponding hinge part in the box.

The present invention is directed to a snap-in hinge for a plastic box having a pivoted cover, the cover of the box being made of one piece of plastic which when the hinge parts are snapped together forms the complete box. In FIG. 1, the top cover is indicated at 10 and the hinges at 12. In the other figures, the box is shown at 14 and the cover at 10, the box 14 having rearwardly extending integral hinge members 16 each of which has a bottom opening slot therein as at 18. At one end of member 16, see particularly FIG. 7, there is a rearward integral tab or extension 20 which has no direct connection with the hinge part 16.

Figure 2:
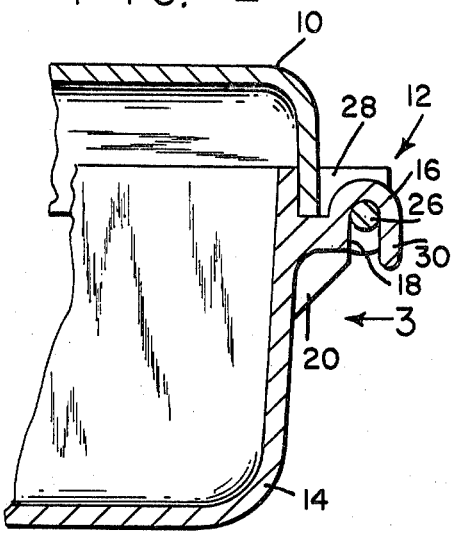
FIG. 2 is a sectional view on line 2—2 of FIG. 1 on an enlarged scale.
Figure 3:
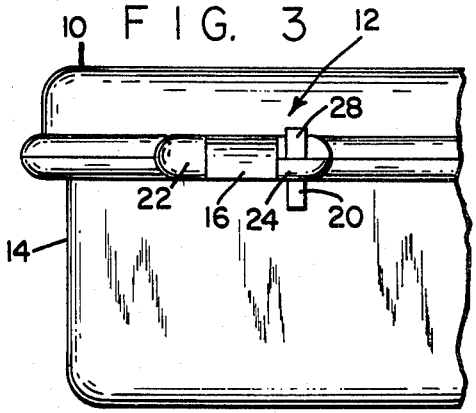
FIG. 3 is a view in elevation looking in the direction of Arrow 3 in FIG. 2.
Figure 5:
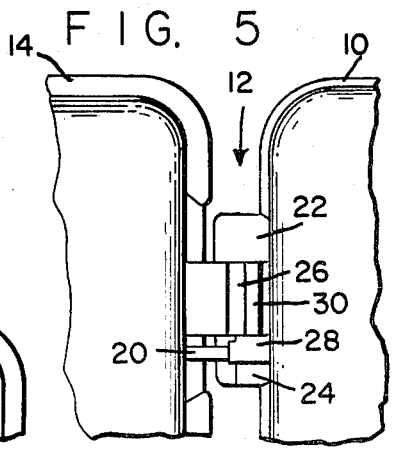
FIG. 5 is a bottom view looking in the direction of Arrow 5 of FIG. 4.
Figure 6:
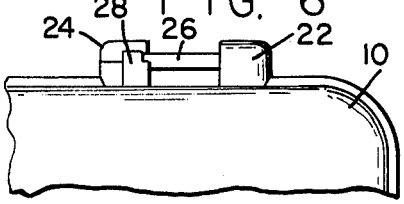
FIG. 6 is a plan view of one hinge part in the cover.

The cover is provided with a pair of spaced lugs 22, 24 with a pin 26 extending therebetween. This pin 26 is snapped into the slot 18 and the springiness of the plastic material is such that when assembled the pin 26 cannot accidentally become detached. As thus far described, the hinge construction except for tab 20 is of generally known construction. An outwardly extending tab 28 on the cover, see FIG. 6, is rotatably aligned with tab 20. These tabs have no interference with each other when the box is closed as in FIGS. 2 and 3, but when the box opens as in FIGS. 4 and 5, they come into contact with each other to limit the cover from pivoting any farther in a clockwise direction, see FIG. 4, than as shown in that figure. This contact is also seen in FIG. 6.

Figure 4:
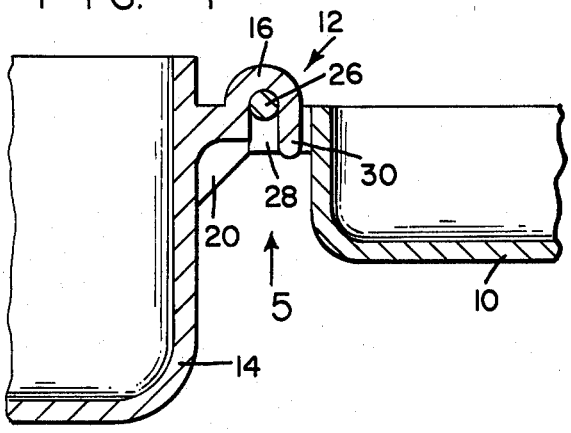
FIG. 4 is a sectional view similar to FIG. 2 but showing the cover open.

At the same time should the assembler attempt to secure the cover to the box by means of pin 26 and slot 18 in any way but that shown, this cannot be done as the member 28 extends into the path of the part of the hook which is shown in FIG. 4 at 30 and prevents the pin from entering the slot; and if the cover is moved laterally with respect to pin 26, the tabs 20 will be in the way of tab 28. Therefore it is seen that the new hinge construction includes two functions; one to aid in the assembly of the parts in the first place, and the other to prevent an unwanted too wide opening of the cover of the box, providing for easier access of the contents because the cover 10 and box 12 are paralel to each other and the contents thereof are laid out more or less as in a coplanar arrangement.

I claim:

1. A plastic box having an open rim, and a plastic cover therefor, integral hinge-forming means adjacent the rim of the box and corresponding and complementary hinge-forming means on the rim of the cover, the hinge means on the box comprising a generally cylindrical member having a downwardly opening slot therein, and the hinge means on the cover comprising a pin adapted to be snapped into the slot so as to hold the pin in a rotary manner in the hinge means on the box, a tab associated with the pin on the cover and a tab associated with the cylinder member on the box, tabs being substantially coplanar in a plane transverse to the axes of the pin, said tabs being arranged to contact each other and act as stops when the cover is open to a 180° relationship with respect to the box.

2. The box of claim 1 wherein said stops prevent assembly of the pin in the slot except in one way only, by interfering with the hinge-forming parts of both box and cover.

3. A plastic box having a wall and hinge-forming part extending from said wall adjacent to the open top of the box thereof comprising a semi-cylindrical hook-shaped member having a downwardly open slot therein, there being a rearwardly extending tab closely adjacent to one end of said cylindrical member but slightly spaced therefrom, an all plastic cover including a pin for snapping into said slot to hingedly connect the cover to the box, a pair of abutements on the cover, said pin extending between the abutments in spaced relation with respect to said cover to accommodate the outer extending end of the hook when the parts are secured together, an extending tab on said cover closely adjacent one of said abutments and being located in the rotary path of the tab on the box and contacting the tab on the cover to stop the cover from opening more than 180° with respect to the box.

said tabs interfering with each other to prevent assembly of the pin into the slot in but a single relationship.

* * * * *